United States Patent [19]

Long et al.

[11] 4,274,759

[45] Jun. 23, 1981

[54] NON-RETURN HOT WATER DIVING SUIT

[75] Inventors: Richard W. Long; Robert T. Stinton, both of San Diego, Calif.

[73] Assignee: Diving Unlimited International, Inc., San Diego, Calif.

[21] Appl. No.: 11,200

[22] Filed: Feb. 12, 1979

Related U.S. Application Data

[63] Continuation of Ser. No. 835,679, Sep. 22, 1977, abandoned.

[51] Int. Cl.[3] ..... B63C 11/02

[52] U.S. Cl. ..... 405/186; 2/2.1 R

[58] Field of Search ..... 405/185, 186; 2/2.1 R; 251/118, 127; 137/613, 611

[56] References Cited

U.S. PATENT DOCUMENTS

| | | | |
|---|---|---|---|
| 1,226,148 | 5/1917 | Walters | 2/2.1 R X |
| 2,413,386 | 12/1946 | Schulz | 2/2.1 R X |
| 3,391,686 | 7/1968 | Wiswell | 2/2.1 R X |
| 3,449,761 | 6/1969 | Long | 2/2.1 R |
| 3,473,165 | 10/1969 | Gran et al. | 2/2.1 R |
| 3,568,209 | 3/1971 | O'Neill et al. | 2/2.1 R |

FOREIGN PATENT DOCUMENTS

| | | | |
|---|---|---|---|
| 1429303 | 1/1966 | France | 2/2.1 R |

*Primary Examiner*—Dennis L. Taylor
*Attorney, Agent, or Firm*—Brown & Martin

[57] ABSTRACT

A non-return hot water diving suit in which hot water is supplied to keep the diver warm is exhausted from the suit through a single outlet valve, readily accessible to the diver. In the event of failure of the hot water supply the valve can be quickly closed, trapping the existing hot water in the suit and extending the length of time available for the diver to return to safety. In the preferred form the valve is combined with a flow controlling baffle, which will allow normal hot water outlet flow, but inhibits sudden or rapid intake of cold water through the open outlet.

11 Claims, 9 Drawing Figures

NON-RETURN HOT WATER DIVING SUIT

This is a continuation of application Ser. No. 835,679 filed 9/22/77 now abandoned.

BACKGROUND OF THE INVENTION

The type of hot water diving suit shown and described herein is manufactured by Diving Unlimited International of San Diego, California, in both closed circuit and non-return or open circuit configurations. The suit is basically loose fitting and contains water distributing tubes to conduct hot water to all parts of a divers body inside the suit. Hot water is supplied from a source on the surface through a hose connected to the suit, along with the breathing air supply, distribution of the hot water being controlled by a diver operated manifold valve on the suit. In the non-return type of suit, the hot water is allowed to leak out at a controlled rate, at which the available supply can maintain a comfortable temperature in the suit. This type of suit enables a diver to work for extended periods at great depths, of 600 to 1000 feet or more, in near freezing water.

A typical example of such use is in the installation of valves and connections for oil wells on the ocean floor. For deep diving operations of this type a pressurized diving bell or similar refuge is situated near the work area, so that the diver need not depressurize between work periods.

If the hot water supply is interrupted for any reason, the diver must reach a heated refuge very quickly, or the exposure to the cold water can be fatal. About five minutes is the limit at which a diver can expect to survive without heat in near freezing water at great depths. Since the cold exterior water must extract all the heat from the hot water in the suit before starting to reduce body heat, it is essential to retain as much hot water in the suit as possible.

When the suit is equipped with multiple outlet valves for exhausting the hot water, all valves must be closed quickly in an emergency. With the valves open, any movement of the diver which distorts the suit causes a pumping action through the valves, by which hot water is forced out and cold water is drawn in. It is therefore essential for the diver's safety to provide rapid and positive means for sealing the suit, to retain the hot water and prevent intake of cold water.

SUMMARY OF THE INVENTION

The non-return hot water diving suit described herein has a single hot water outlet valve, which is readily accessible to the diver and can be closed rapidly in the event of failure of the hot water supply. The suit itself has integral boots, sealed gloves and helmet and is entered through a single waterproof zippered opening, the single outlet valve thus being the only opening in the occupied suit. Hot water is supplied through a hose from a suitable source and is distributed to the various parts of the suit through a manifold valve mounted on the suit. If the hot water failure is due to a break in the supply hose, the manifold valve can be closed to prevent hot water loss by back flow through the hose.

In the preferred form the outlet valve is positioned on the chest and is thus visible as well as accessible. A large twist-lock control knob actuates the valve and provides positive closure. On the inside of the suit at the valve position is a flow control pocket containing a porous baffle, which will allow water to be exhausted at the normal low flow rate of the hot water supply, but which resists sudden or rapid flow of cold water entering the suit.

The primary object of this invention, therefore, is to provide a new and improved non-return hot water diving suit.

Another object of this invention is to provide a non-return hot water diving suit having a single water outlet, with a quickly operable closure valve.

Another object of this invention is to provide a hot water diving suit in which the outlet valve permits normal outlet flow but resists rapid intake of cold water.

A further object of this invention is to provide a hot water diving suit which will greatly extend the survival time of a diver in the event of failure of the hot water supply.

Other objects and advantages will be apparent in the following detailed description, taken in conjunction with the accompanying drawing in which.

DESCRIPTION OF THE PREFERRED EMBODIMENT

Figure 1:
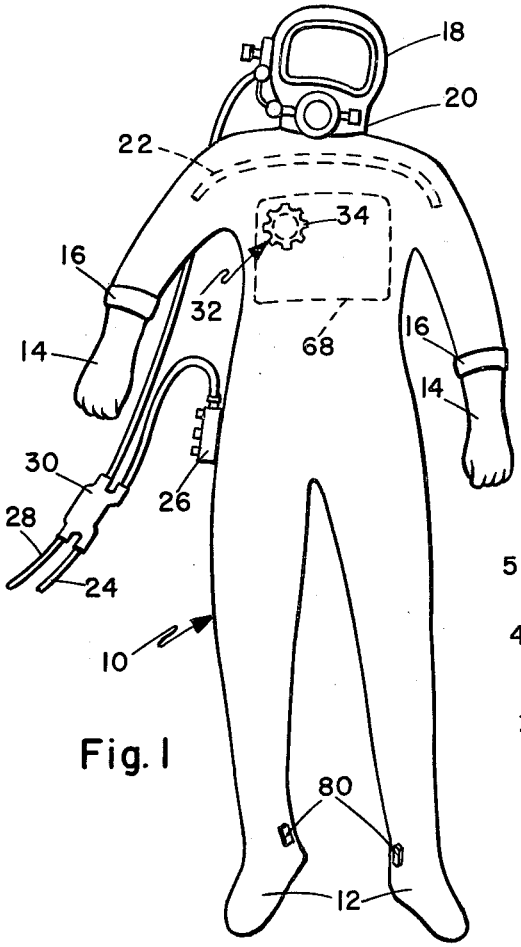
FIG. 1 illustrates a typical hot water diving suit incorporating the single valved outlet.

The diving suit 10, illustrated in FIG. 1, is basically of the type disclosed in applicant's prior U.S. Pat. No. 3,449,761, entitled Heated Underwater Diving Suit. To provide a sealed environment, however, the present suit has integral boots 12, gloves 14 with wrist seals 16 and a helmet 18 with a sealed neck 20. Separate sealed boots could be used if desired, but the suit with integral boots is more secure under working conditions. A single waterproof zipper 22 across the shoulders at the back provides easy access to the suit. The suit is constructed primarily of neoprene coated and reinforced with nylon, or similar material, the parts being joined by a combination of adhesive bonding and stitching.

Figure 9:
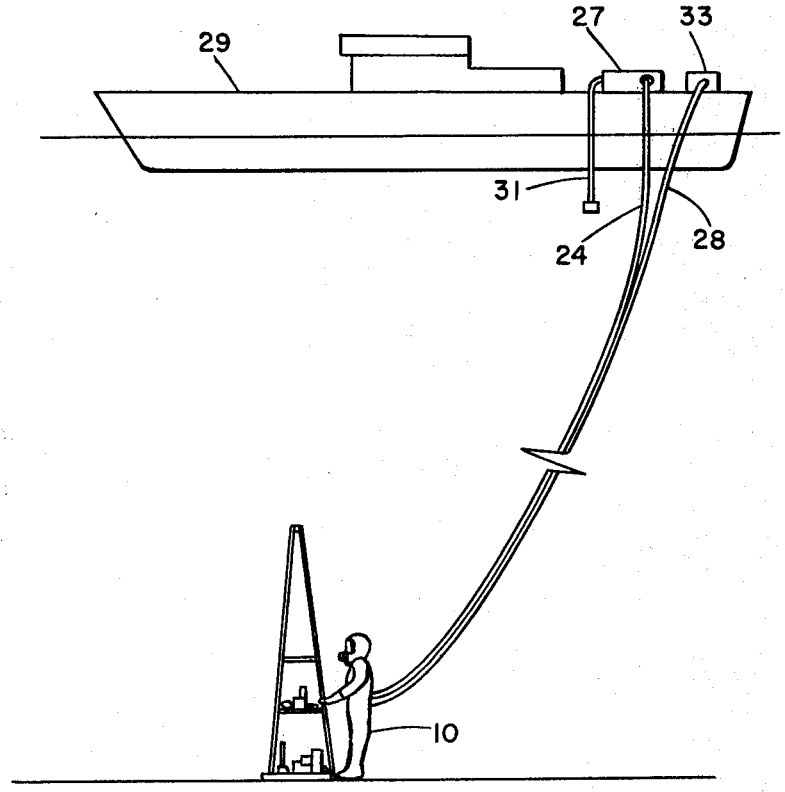
FIG. 9 illustrates a typical diving operation using the suit and associated support equipment.

Hot water is supplied through a hose 24 to a manifold valve 26 mounted on the side of the suit, distribution being described in the above mentioned U.S. Patent. A suitable water heater is disclosed in applicant's prior U.S. Pat. No. 3,762,392, entitled Hot Water Heater System for Divers. In FIG. 9 the water heater 27 is shown as being carried on a vessel 29 and has a pick-up hose 31 extending into the water of supply. As illustrated, breathing gas is supplied by a pump 33 to helmet 18 through a hose 28, which is coupled to an inline heater 30 in which the gas is heated by the hot water supply for the diver's comfort. This type of heater is disclosed in applicant's U.S. Pat. No. 4,013,122, entitled Divers Gas Heater.

The outlet valve 32 is installed in the chest portion of the suit, with the control knob 34 visible and accessible to the diver. Outlet valve 32 includes a cylindrical body 36 having a rear flange 38, which is secured to a hard rubber patch 40 by a retaining ring 42 and rivets 44, or the like. Patch 40 is sealed to the inside of the suit wall 46, with the body 36 protruding through an opening 48 in the wall. Body 36 has circumferentially spaced outlet openings 50. At the rear of the body are cross arms 52 supporting a forwardly projecting axial pin 54.

Figure 4:
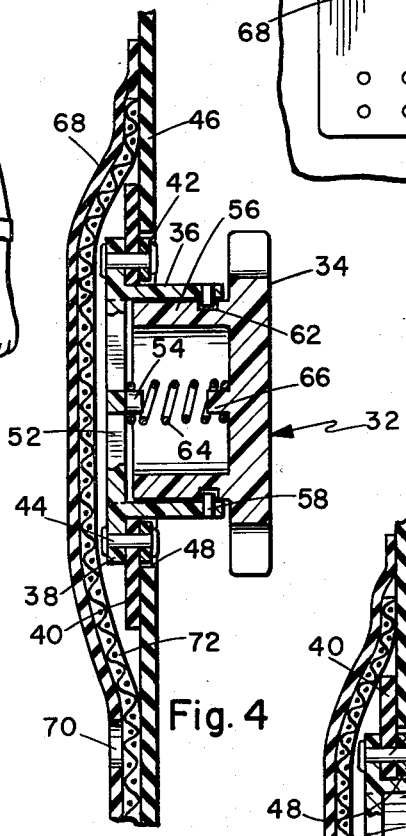
FIG. 4 is a sectional view similar to FIG. 3, but with the valve closed.
Figure 3:
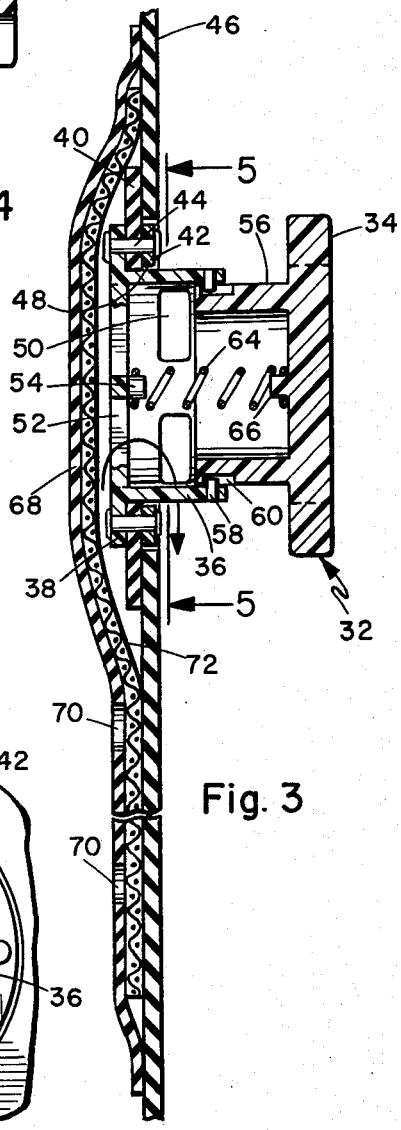
FIG. 3 is an enlarged sectional view taken on line 3—3 of FIG. 2.
Figure 6:
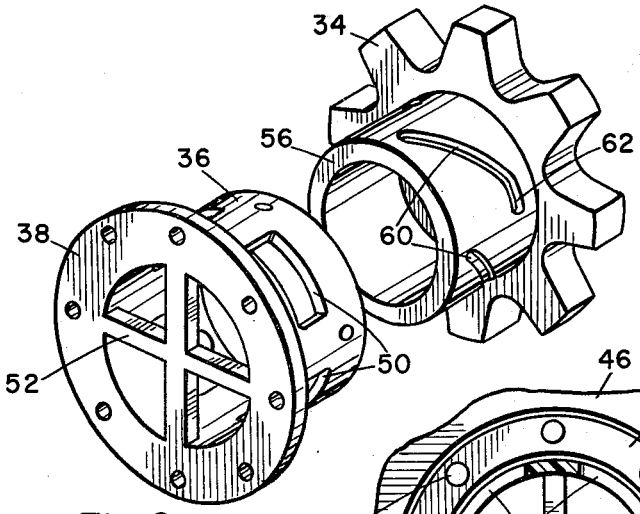
FIG. 6 is a perspective view of the valve and valve body components separated.
Figure 5:
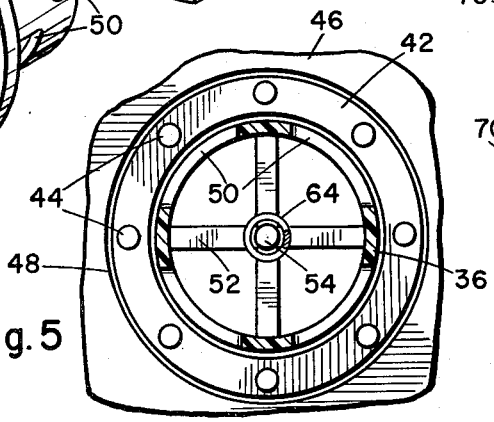
FIG. 5 is a sectional view taken on line 5—5 of FIG. 3.

Control knob 34 is attached to or integral with a cylindrical valve element 56, which is a close sliding and rotating fit in valve body 36. The valve element is held by retaining pins 58 projecting inwardly through body 36 into helical grooves 60 in the valve element. At the outer ends of helical grooves 60 are circumferentially extending sockets 62. When control knob 34 is turned, in a clockwise direction as illustrated, the valve element 56 is screwed into body 36 until the retaining pins 58 enter sockets 62 and lock the valve element in the closed position, completely covering outlet openings 50 as in FIG. 4. A return spring 64, fitted between pin 54 and a similar pin 66 inside valve element 56, biases the valve element to the open position of FIG. 3 when the knob 34 is turned sufficiently to release the retaining pins 58 from sockets 62. It should be understood that the specific structure of the valve is not critical, the important feature being an easily operable valve with a positive lock in the closed position.

The valve opens into a pocket 68 of neoprene or the like, which extends across a substantial portion of the chest area and is peripherally sealed to the inside of the suit wall 46. In the pocket 68 are multiple outlet ports 70, offset from the valve and extending across the pocket to admit water from the suit to the pocket. Contained in the pocket is a baffle panel 72, which is peripherally sealed to the suit wall and pocket to prevent direct flow of water from the suit to the valve. One suitable material for the baffle panel is a woven plastic fabric such as TRI-LOK, made by Uniroyal. This material will allow passage of water at a slow rate from the suit through the outlet, the normal flow of hot water being on the order of two gallons a minute. This will vary depending on ambient water temperature, operating depth and the individual diver's comfort requirements. However, the baffle impedes rapid flow, particularly in sudden surges. The internal pressure in the suit will normally prevent intake of outside water, but motion of the diver causes a pumping action in the suit which might otherwise draw in cold water. Also, in the event of failure of the hot water supply, the baffle prevents a sudden intake of cold water until the diver can close the valve.

With the valve closed the hot water in the suit is trapped, the only other connection being the supply hose 24. If the hose is damaged or the hot water source is otherwise cut off, manifold valve 26 can be closed to prevent back flow. Since the heat of the trapped hot water must be extracted before the surrounding cold water can begin to reduce body heat, the diver has much more time to reach safety or signal for assistance.

Figure 2:
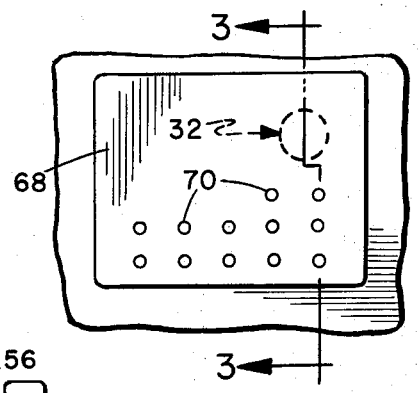
FIG. 2 is an enlarged view of the rear of the valve installation, as taken from inside the suit.
Figure 7:
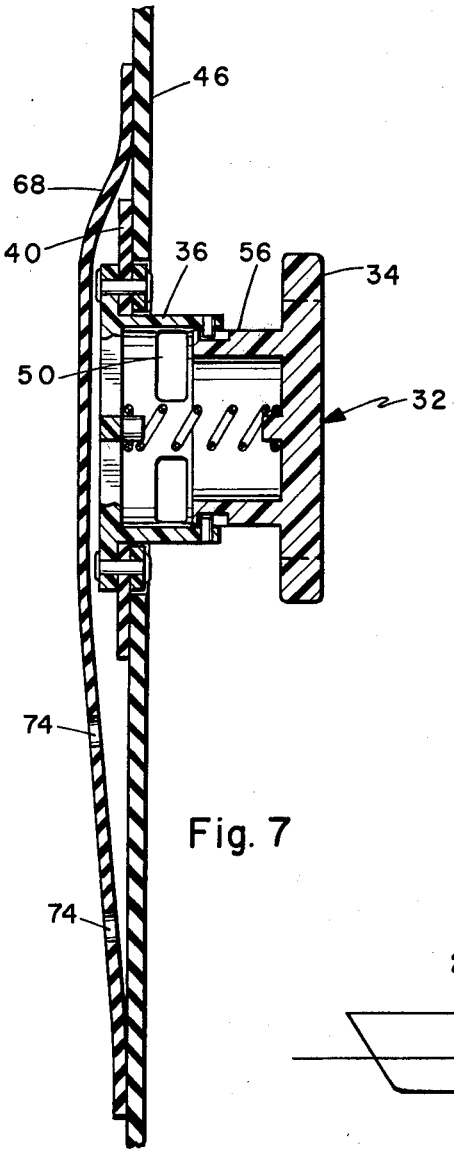
FIG. 7 is a view similar to FIG. 3 showing an alternative flow control arrangement.

If the ambient water temperature is not extremely low, but still hazardous with prolonged exposure, a simpler form of flow control may be used, as in FIG. 7. In this arrangement, the valve structure and pocket are described above, but the baffle panel is omitted from the pocket. Flow is controlled by the number and size of the smaller ports 74, which are offset from the valve, as in FIG. 2, to prevent direct flow to the valve. The pocket is also secured to the suit to lie almost flat against wall 46, with a minimum of open space in the pocket. The outgoing water flow is thus further restricted and incoming water is resisted by internal suit pressure against the pocket.

Figure 8:
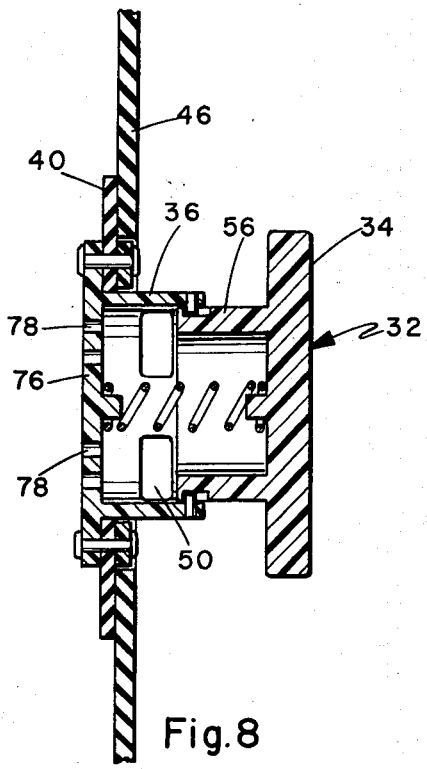
FIG. 8 is a view similar to a portion of FIG. 7, showing a further flow control arrangement.

A further arrangement is illustrated in FIG. 8, which is suitable for conditions less than immediately hazardous, but still representing an undesirable risk to the diver. In this configuration, the pocket is omitted and flow is controlled directly through the valve. Instead of the open valve body obstructed only by the cross arms, the rear of the valve body 36 is closed by a baffle wall 76 having small flow restricting ports 78 therein. The number and size of the ports is selected to accomodate the required exhaust flow of water at a low rate, but prevent sudden surges of incoming cold water.

In each instance the suit is provided with a single water outlet which is readily accessible to the diver and can be quickly shut off to seal the suit. It should be noted that the suit has small drain valves 80 at the lower ends of the legs, but these are locked shut and are opened only to drain the suit when the diver is out of the water.

Having described my invention, I claim:

1. A non-return hot water diving suit, comprising:

a waterproof body encasing suit providing a sealed interior to protect the body against cold exterior water;

the suit having inlet means for connection to a supply of hot water to admit the hot water into the interior of the suit;

the suit further having a single hot water outlet for allowing hot water to be exhausted from the interior of the suit therethrough, the outlet including a positive shut-off valve; and flow restricting means disposed between the interior of the suit and the outlet for allowing hot water to be exhausted from the interior of the suit through the outlet at a predetermined substantially constant first rate and for preventing cold exterior water from surging into the interior of the suit through the outlet at a second rate significantly greater than the first rate due to pumping action in the suit or failure of the hot water supply.

2. A diving suit according to claim 1 in which the flow restricting means includes a pocket member peripherally sealed to the interior wall of the suit and covering the outlet, the pocket member having a plurality of ports extending therethrough for permitting hot water to flow from the interior of the suit into the space defined between the pocket member and the interior wall.

3. A diving suit according to claim 2 wherein the ports are offset from the outlet.

4. A diving suit according to claim 2 wherein the flow restricting means further includes a porous baffle panel positioned between the pocket member and the outlet.

5. A diving suit according to claim 4 wherein the baffle panel is peripherally sealed to the interior wall of the suit.

6. A diving suit according to claim 4 wherein the baffle panel is made of a woven material.

7. A diving suit according to claim 2 wherein the suit has a chest portion in which the outlet is positioned, and wherein the pocket member extends over a major portion of the chest portion.

8. A diving suit according to claim 2 wherein the pocket member is peripherally sealed to the interior wall of the suit so that it lies substantially flat thereagainst.

9. A diving suit according to claim 1 in which the flow restricting means includes a porous baffle panel peripherally sealed to the interior wall of the suit and covering the outlet.

10. A diving suit according to claim 9 wherein the baffle panel is made of a woven material.

11. A non-return hot water diving suit, comprising:

a waterproof body encasing suit providing a sealed interior to protect the body against cold exterior water, the suit having interior and exterior walls and a chest portion;

the suit further having inlet means for connection to a supply of hot water to admit the hot water into the interior of the suit;

the suit further having a single hot water outlet located in the chest portion for allowing hot water to be exhausted from the interior of the suit therethrough, the outlet icluding a positive shut-off valve; and flow restricting means disposed between the interior of the suit and the outlet for allowing hot water to be exhausted from the interior of the suit through the outlet at a predetermined substantially constant first rate and for preventing cold exterior water from surging into the interior of the suit through the outlet at a second rate significantly greater than the first rate due to pumping action in the suit or failure of the hot water supply, the flow restricting means including:

a pocket member peripherally sealed to the interior wall of the chest portion of the suit and covering the outlet, a pocket member having a plurality of ports extending therethrough for permitting hot water to flow from the interior of the suit into the space defined between the pocket member and the interior wall of the suit, the pocket member extending over a major portion of the chest portion and lying substantially flat thereagainst; and a porous baffle panel made of a woven material positioned between the pocket member and the outlet, the panel being peripherally sealed to the interior wall of the suit so that it covers the outlet.

* * * * *